US005819485A

United States Patent [19]

Lane et al.

[11] Patent Number: 5,819,485

[45] Date of Patent: Oct. 13, 1998

[54] INTERIOR MOLDING SYSTEM

[75] Inventors: Chris Lane, Wilsonville; Michael Busher, Portland, both of Oreg.

[73] Assignee: Exterior Specialty Systems, Inc., Portland, Oreg.

[21] Appl. No.: 929,868

[22] Filed: Sep. 15, 1997

[51] Int. Cl.[6] ..... E04B 2/00

[52] U.S. Cl. ..... 52/287.1; 52/716.1

[58] Field of Search ..... 52/287.1, 716.1, 52/288.1, 272, 280

[56] References Cited

U.S. PATENT DOCUMENTS 5,199,237 4/1993 Juntunen ..... 52/287.1
5,555,688 9/1996 Logan ..... 57/287.1 X
5,579,617 12/1996 Schiedegger et al. ..... 52/287.1 X
5,592,797 1/1997 Logan et al. ..... 52/287.1 X
5,694,726 12/1997 Wu ..... 52/287.1
5,711,123 1/1998 Lamont et al. ..... 52/287.1

*Primary Examiner*—Creighton Smith
*Attorney, Agent, or Firm*—Chernoff, Vilhauer, McClung & Stenzel, LLP

[57] ABSTRACT

A trim detail system with trim detail has an exterior surface with a contour for attachment to a structure. The trim detail includes a base material, such as foam, having an exterior surface with a contour generally matching the contour of the trim detail. A first layer of material, such as foam-coat, overlays the exterior surface of the base material that is harder than the base material. A second layer of material, such as a gypsum-based "drywall" material, overlays the first layer of material that is softer than the first layer of material.

52 Claims, 4 Drawing Sheets

INTERIOR MOLDING SYSTEM

BACKGROUND OF THE INVENTION

The present invention relates to an improved trim molding.

Interior trim detail, otherwise known as molding, is added in buildings to improve its decorative appearance. One type of interior trim detail is decorative crown molding which is secured to the joint interconnecting the top of a wall and a ceiling. Examples of other types of interior trim detail are, for example, (1) chair rails which are bands of trim located approximately four feet high on a wall, (2) capitals which are trim at the top of a column, (3) pedestals which are trim at the bottom of a column, and (4) columns which are vertically oriented trim attached to a wall to provide the appearance of a column. The trim detail may also be used on the exterior of the building, if desired.

Interior trim detail traditionally is constructed by forming expanded metal lath or chicken wire into the basic contour of the particular trim. The metal lath or chicken wire is then attached to the building at the desired location, such as with the use of nails or screws. Thereafter, wet plaster material is applied to the metal lath or chicken wire and shaped to the desired form, generally known as screening the plaster. Unfortunately, such a process requires skilled artisans to mold an interior trim that is aesthetically pleasing and uniform along its length. Also, such construction techniques are labor intensive and thus expensive. Accordingly, while many construction projects would like to use interior trim detail, the construction expense is generally prohibitive.

An alternative technique employed to manufacture interior trim detail involves obtaining sheet metal negatives of the desired exterior trim contour. In other words, the interior of the metal negative has the desired exterior shape of the resultant trim. A thin layer of foam coat material is spread within the metal negative. The foam coat material is a gypsum-based, glass-fiber reinforced acrylic coating intended to be used as a foam plastic thermal barrier. Such foam coat is available from Hamilton Materials, Inc. of Orange, Calif. under the trade name FC-90 Foam Coat Foam Plastic Protection. A semi-rigid expanded polystyrene foam plastic material with the same shape as the interior of the metal negative is pressed into the metal negative. The foam coat adheres to the foam while it dries. The foam, with the attached foam coat, is then removed from the metal negative and sanded to smoothed out its surface. Present building codes require the use of a fire rated coating material over foam, such as foam coat. Unfortunately, the production rate of the aforementioned process is limited to the number of metal negatives. In addition, significant time is required to properly position the foam within the negative and maintain its position so that a generally even layer of foam coat is applied thereon. Unfortunately, the foam coat frequently does not have an even surface using such a technique. Moreover, the foam coat dries into a hardened material, substantially harder than the underlying foam, which is difficult to sand smooth because of the fibre material in the foam coat. Further, the fibre reinforcement within the foam coat makes it difficult to sand the trim in a manner to provide sharp corners, which is a frequently desired shape for trim. Accordingly, when using such a product all of the corners much be round, even if such a rounded corner design is not desired. Also, such a construction process is labor intensive and is difficult to maintain a sufficiently high quality output. In addition, it is difficult to manually coat the foam with foam coat because unhardened foam coat is a gooey, sticky material which does not flow well nor spread evenly.

The traditional method for attachment such trim detail involves fastening the trim detail with glue or screws to the structure. Thereafter, the next piece of trim detail is likewise fastened with glue or screws to the structure adjacent to the previous trim detail. A joint remains between the two pieces of trim detail that needs to be covered and secured together. A mesh tape is overlaid on the joint and then foam coat material is overlaid on the mesh tape. Unfortunately, the mesh tape has a tendency to float within the foam coat material and thus additional layers of foam coat material may be necessary to cover the mesh tape. The resultant buildup of foam coat material may be difficult to smoothed out to make the joint unnoticeable. Further, significant time is required to cover such joints using the traditional method, which is expensive.

What is desired, therefore, is a molding that is both inexpensive to manufacture and inexpensive to install. Further, the molding should comply with the fire retardant building standards, have a hard exterior surface to resist being inadvertently damaged, quickly finish to a smooth exterior surface that may include sharp corners, provide any desired shape, and manufacturable in large quantities without excessive labor costs.

SUMMARY OF THE INVENTION

The present invention overcomes the aforementioned drawbacks of the prior art by providing a trim detail system with trim detail having an exterior surface with a contour for attachment to a structure. The trim detail includes a base material, such as foam, having an exterior surface with a contour generally matching the contour of the trim detail. A first layer of material, such as foam-coat, overlays the exterior surface of the base material and is harder than the base material. A second layer of material, such as a gypsum-based "drywall" material, overlays the first layer of material and is softer than the first layer of material.

In the preferred embodiment the first layer is preferably gypsum-based, provides the necessary fire rating, and hardens to a hardness substantially greater than the underlying base material to provide structural integrity to the trim detail. The second layer is preferably gypsum-based "drywall" material which provides the benefits of being easily sanded, easily spread and flows onto surfaces, easily finished to both a smooth finish and sharp corners, if desired. Further, such a gypsum-based second layer is inexpensive, reusable if it spills, and easy to clean up with water. With the first layer and second layer both gypsum-based they are compatible with one another and form a multi-layer structure that maintains its integrity over time.

The system also includes a spreading machine with a table and container to automate the manufacturing of the trim detail. With such a spreading machine the multiple layers are easily spread evenly onto the base material. Further, the spreading machine alleviates the difficultly associated with troweling FC-90 Foam Coat material (first layer) as suggested by the manufacturer which is a difficult process because unhardened FC-90 Foam Coat is a gooey, sticky material which does not flow well nor spread evenly.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
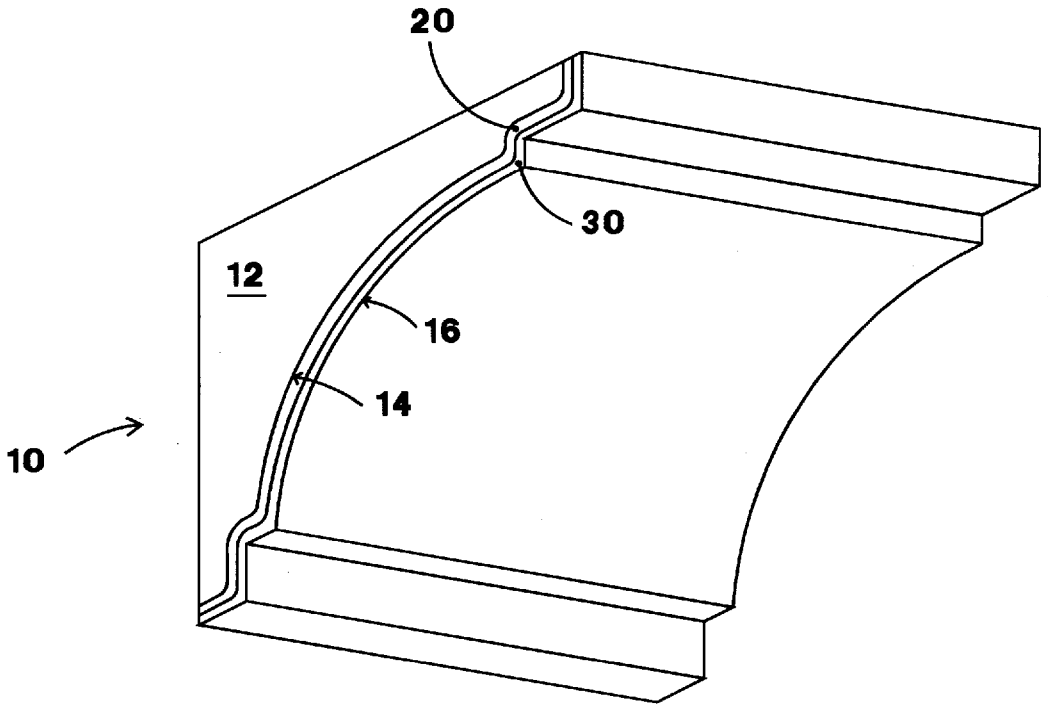
FIG. 1 is a perspective view of a piece of an exemplary embodiment of trim detail of the present invention showing a base material, a protective layer, and a finish coat.

Referring to FIG. 1, a piece of trim detail 10 includes a base material 12 which has an exterior surface 14 with a contour generally matching an exterior contour 16 of the trim detail 10. The preferred base material 12 is foam, such as expanded polystyrene foam having a nominal density of 1.0 pound per cubic foot, a minimum density of 0.9 pound per cubic foot, a maximum flame-spread rating of 25, and a smoke developed rating of no more than 450. Alternatively, the base material 12 may be any suitable type of material, such as for example, paper products, recycled paper, wood products, and plastic. The selected base material 12 should be moldable, suitable to being cut to the desired shape, and not susceptible to warpage. The base material 12 is cut to the desired shape for the trim detail 10.

A protective layer 20 is overlaid, or otherwise attached to and supported by, the base material 12. The protective layer 20 is a thermal barrier which complies with building codes, such as the 1994 Uniform Building Code, requiring fire protection of the base material 12 for inclusion within a building. Preferably the protective layer 20 is a gypsum-based glass-fibre reinforced acrylic coating intended to be used as a foam plastic thermal barrier. The protective layer 20 preferably contains 0.25 percent chopped fiberglass. The gypsum-based protective layer 20 is preferably FC-90 Foam Coat Foam Plastic Protection from Hamilton Materials, Inc. of orange, Calif. which is suitable for application directly to expanded polystyrene foam base material 12. The FC-90 Foam Coat material adheres well to foam, provides the necessary fire rating, and hardens to a hardness substantially greater than the underlying base material 12, such as foam. As such, the FC-90 Foam Coat material provides structural integrity to the trim detail 10.

FC-90 Foam Coat is mixed with water at a ratio of approximately 2 gallons of water per 25-pound bag of FC-90 Foam Coat. The mixing is by an electric drill, with a paddle bringing the mixture to a working consistency. The FC-90 Foam Coat may be troweled onto the base material 12 and cured for 24 hours to dry as it becomes significantly harder than the underlying base material 12. Unfortunately, the toweling of the FC-90 Foam Coat material as suggested by the manufacturer is a difficult process because unhardened FC-90 Foam Coat is a gooey, sticky material which does not flow well nor spread evenly. Accordingly, a spreading machine 60 is used to spread the protective layer 20, as described later.

As previously described, the mere use of the FC-90 Foam Coat provides a surface which is difficult to sand smooth because of the fibre material in the foam coat, difficult to sand in a manner to provide sharp corners, and is labor intensive. To overcome these limitations while still maintaining the required standards of the 1994 Uniform Building Codes, the present inventors came to the realization that a finish coat 30 of material may be overlaid on the protective layer 20. The spreading machine 60 is used to spread the finish coat 30, as described later. The finish coat 30 is preferably a gypsum-based compound so that it is compatible with the gypsum based protective layer 20 thereby making a good bond therebetween. Such a gypsum-based compound may be selected from a class of compounds generally referred as "drywall" compounds which are used in the construction trade. Drywall compounds primarily include gypsum, glue, and water. The preferred drywall compound is sold under the trade name Hamilton's Topping Compound available from Hamilton Materials, Inc. of Orange, Calif. Such a gypsum-based finish coat 30 provides the benefits of being easily sanded, easily spread and flows onto surfaces, easily finished to both a smooth finish and sharp corners, if desired. Further, such a gypsum-based finish coat 30 is inexpensive, reusable if it spills, and easy to clean up with water. The finish coat 30 may be any suitable gypsum based product such as hot mud, joint compound, soft top (which includes plastic), and light mud. Alternatively, the finish coat 30 may be any other suitable type of material, such as for example, a cement based product such as plaster (which typically includes cement, sand, silica sand, acrylic primus [glue], lime, and color), and a colored stucco (which typically includes primarily lime, some cement, and color).

The resulting finish coat 30 is then painted or finished in any suitable manner desired by the particular application. Additionally, any suitable number of additional layers may be added between the base material 12, protective layer 20, and finish coat 30, as desired.

Figure 2:
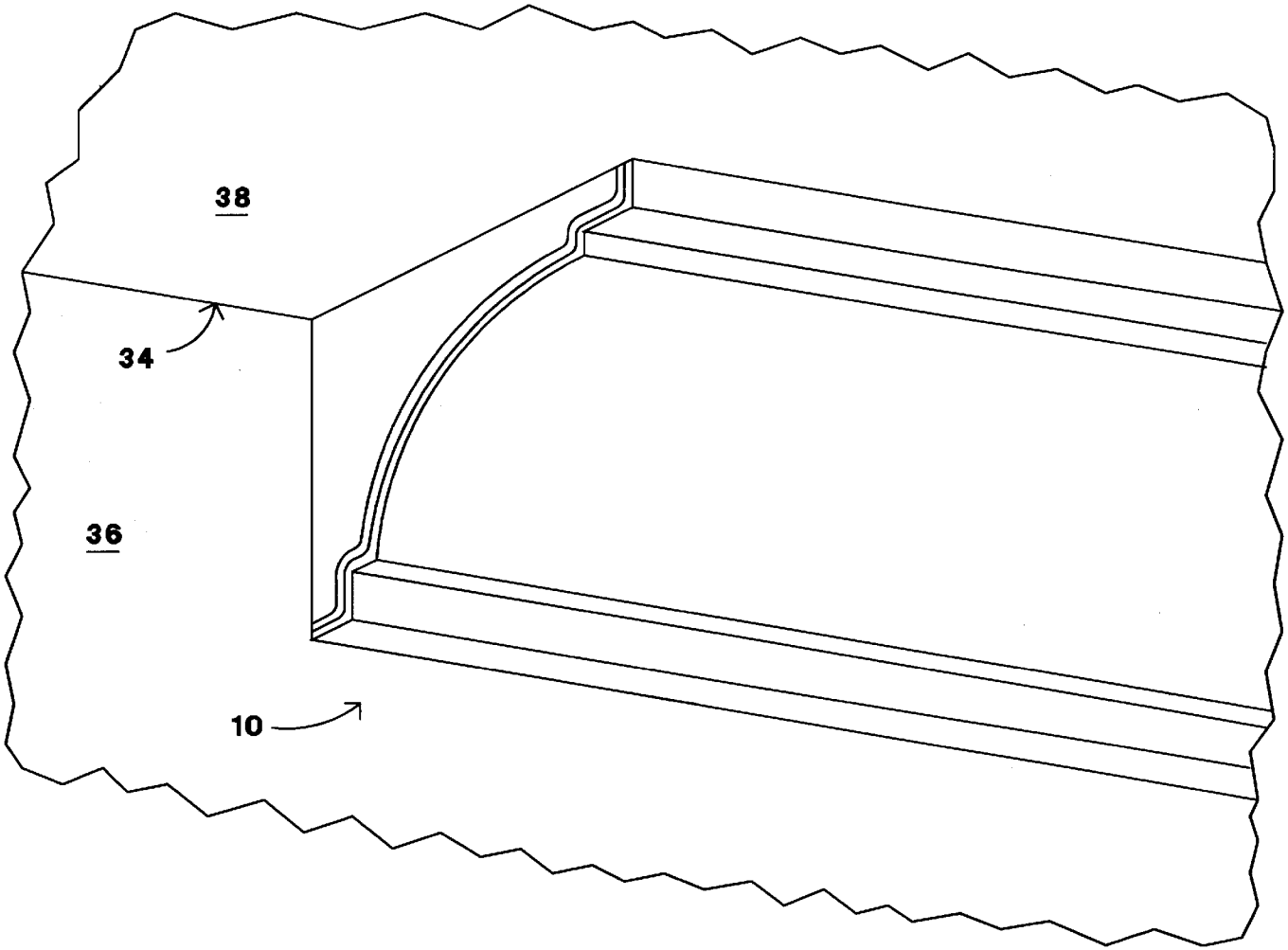
FIG. 2 is a perspective view of the trim detail of FIG. 1 attached to a structure.

Referring to FIG. 2, the trim detail 10 is then adhered, or otherwise attached, with glue or screws to an appropriate structure, such as a corner 34 between a wall 36 and a ceiling 38. Depending upon the design of the trim detail it may likewise be used at other appropriate locations such as chair rails, capitals, pedestals, and columns. The trim detail 10 may also be used on the exterior of the structure, if desired.

Figure 3:
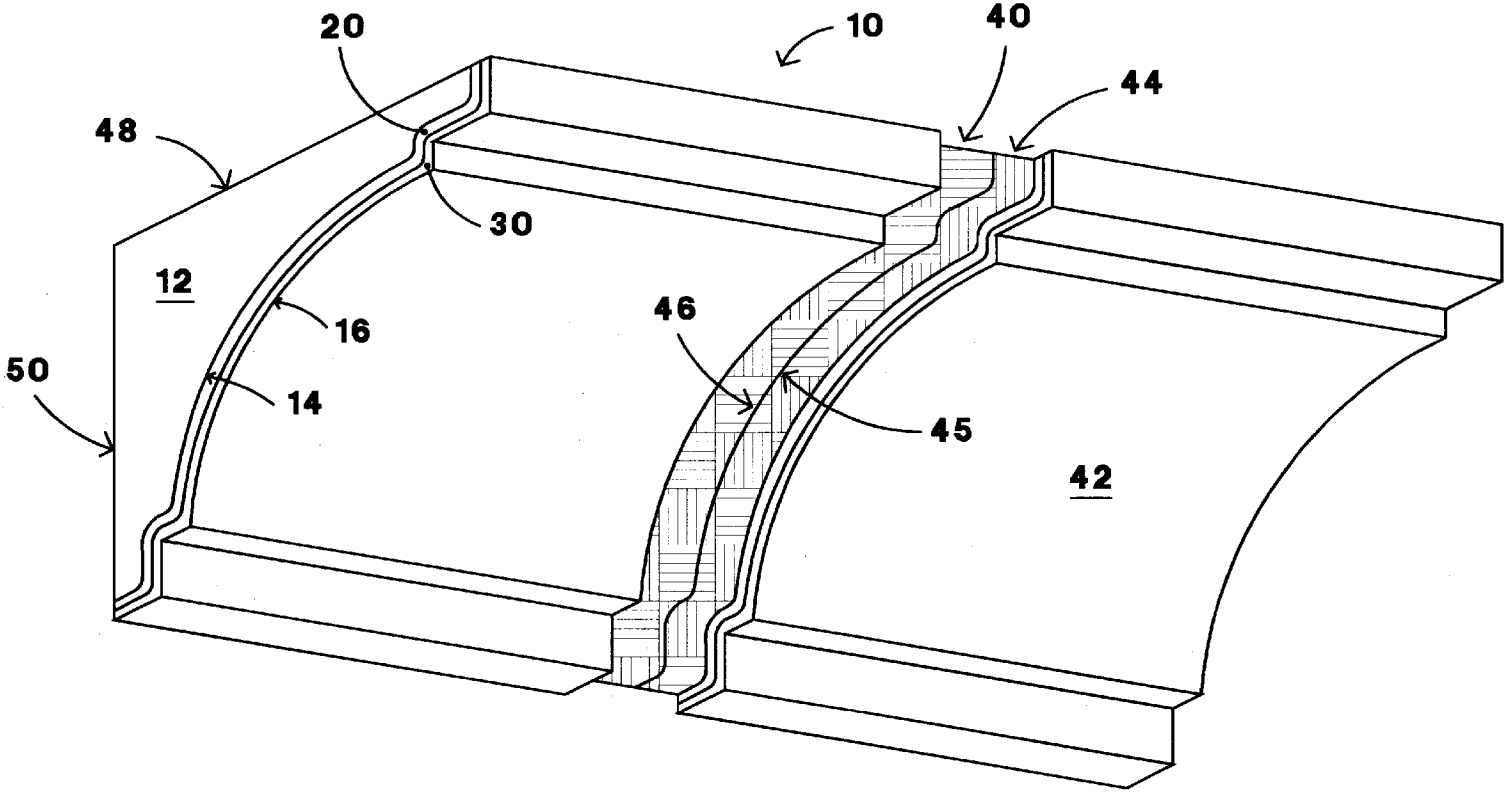
FIG. 3 is a perspective view of two pieces of trim detail of FIG. 1 with recessed portions at respective ends shown attached together to a structure.

Referring to FIG. 3, the trim detail 10 is constructed with at least one end portion 40 where the exterior surface of the base material 12 is free from overlaying by the protective layer 20 and the finish coat 30. Likewise a similar trim detail 42 is constructed with at least one end portion 44 where the exterior surface of the base material is free from overlaying by the protective layer and the finish coat. The end portions 40 and 44 are created by taping over the end portions 40 and 44 of the base material 12 which is thereafter removed together with the applied protective layer 20 and finish coat 30 while still wet and non-hardened. The ends portions 40 and 44 are recessed with respect to the remainder of the trim details 10 and 42. The ends 45 and 46 of the respective trim details 10 and 42 are adhered together with contact cement and the back surfaces 48 and 50 of the trim details 10 and 42 are likewise coated with contact cement, such as Fast Set Adhesive available from STO Corporation of Atlanta, Ga. Thereafter, the trim details 10 and 42 are attached to a suitable structure. The recessed portions of the end portions 40 and 44 are then coated with a protective layer, such as FC-90 Foam Coat, and a finish coat until flush with the finish coat of the adjoining trim details 10 and 42. The use of the recessed portions allows for quicker assembly of multiple trim detail portions while the protective layer overlaying the recessed portions provides the necessary strength and fire rating, and the finish coat is easily sanded flush with minimal time and effort. Further, cementing the ends together prior to attachment to the structure provides more accurate alignment of the trim detail pieces.

Figure 4:
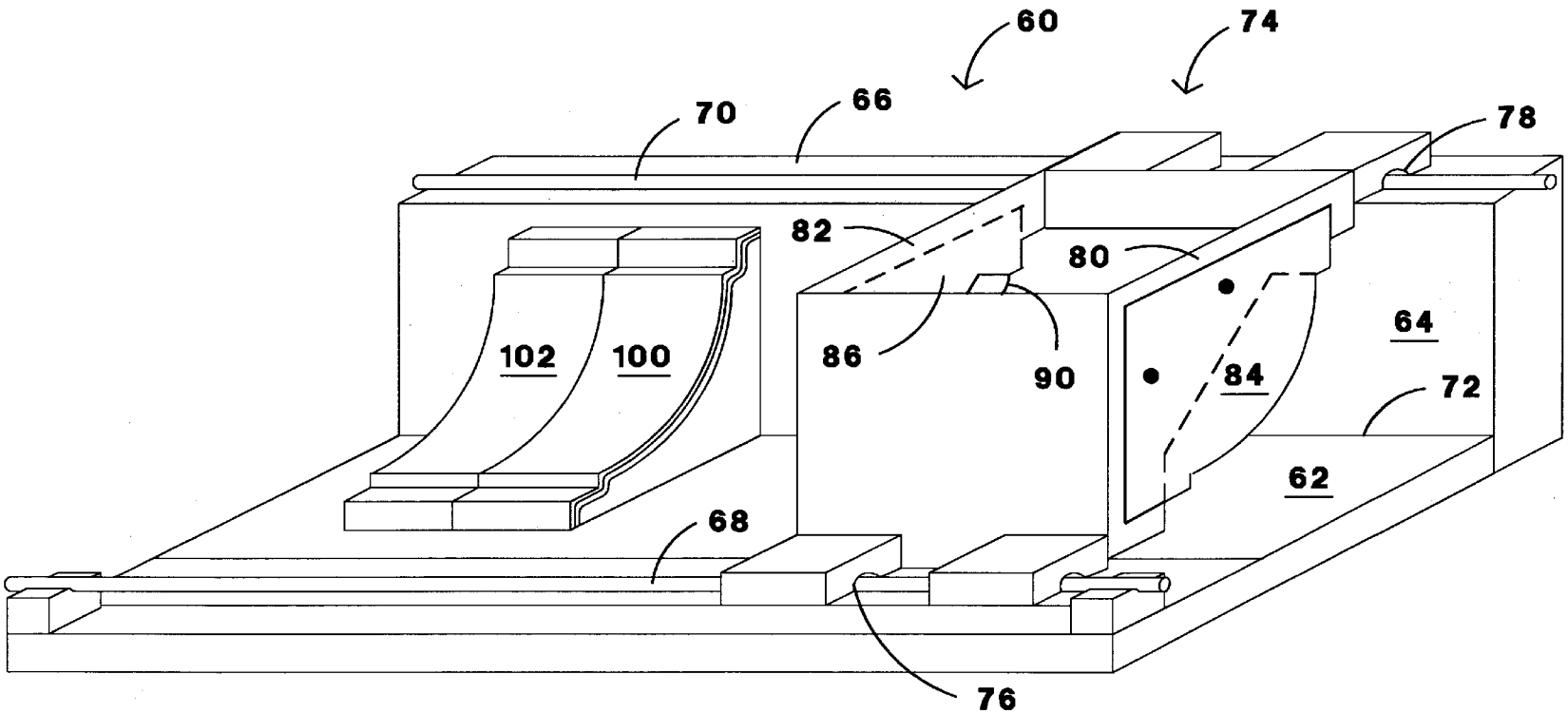
FIG. 4 is a spreading machine for the construction of the trim detail of FIG. 1.

Referring to FIG. 4, the spreading machine 60 is suitable for producing large quantities of trim detail 10 with minimal labor costs. The spreading machine 60 includes a flat base 62, an upright side 64, and a flat top 66 preferably constructed from rigid metal. A lower guide bar 68 and upper guide bar 70 are parallel to one another and the back corner 72 of the spreading machine 60. A container 74 includes recessed portions 76 and 78 which slide on respective guide bars 68 and 70. The container 74 is suitable to alternatively hold substantial amounts of the protective layer material and the finish coat material. The sides 80 and 82 of the container 74 support respective blades 84 and 86 that have an exterior contour 88 and 90 that substantially matches the exterior contour of the base material 100 and 102 supported by the spreading machine 60. During use, the container 74 is filled with protective layer material and slid across the base material 100 and stopped above the base material 102. Then the base material 100 is removed and another piece of base material is placed on the spreading machine 60 and coated with the protective layer from the container 74. Another piece of base material 102 may be located on the other end of the base material 100 to provide a place to stop the container 74 above. In this manner the material within the container 74 does not spill onto the spreading machine 60 after passing beyond either end of the base material 100. The protective layer material within the container is then replaced with the finish coat material and the process is repeated. The result is the multiple layer trim detail 10, as previously described. Moreover, the spreading machine 60 provides substantially even layers of material along the length of the base material 12.

The container 74 may be pressurized to provide a more even layer of material on the base material 12. In addition, the container 74 may be motorized for movement, if desired.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A trim detail having an exterior surface with a contour for attachment to a structure comprising:

(a) a base material having an exterior surface with a contour generally matching said contour of said trim detail;

(b) a first layer of material overlaying said exterior surface of said base material that is harder than said base material; and (c) a second layer of material overlaying said first layer of material that is softer than said first layer of material.

2. The trim detail of claim 1 wherein said second layer of material defines said exterior surface of said trim detail.

3. The trim detail of claim 1 wherein said base material is foam.

4. The trim detail of claim 3 wherein said foam is expanded polystyrene foam.

5. The trim detail of claim 1 wherein said base material is paper.

6. The trim detail of claim 1 wherein said base material is wood.

7. The trim detail of claim 1 wherein said base material is plastic.

8. The trim detail of claim 1 wherein said first layer is a thermal barrier.

9. The trim detail of claim 1 wherein said first layer is gypsum-based.

10. The trim detail of claim 9 wherein said first layer includes glass-fiber.

11. The trim detail of claim 10 wherein said first layer is chemically hardening.

12. The trim detail of claim 1 wherein said first layer is adhered directly to said base material.

13. The trim detail of claim 1 wherein said second layer is adhered directly to said first layer.

14. The trim detail of claim 1 wherein said second layer is gypsum-based.

15. The trim detail of claim 1 wherein said second layer is drywall material.

16. The trim detail of claim 9 wherein said second layer is gypsum-based.

17. The trim detail of claim 1 wherein said second layer includes plastic.

18. The trim detail of claim 1 wherein said second layer is plaster.

19. The trim detail of claim 1 wherein said second layer is stucco.

20. The trim detail of claim 1 further comprising at least one end portion of said exterior surface of said base material free from overlaying by said first layer and said second layer prior to said attachment to said structure.

21. A method of constructing trim detail having an exterior surface for attachment to a structure comprising the steps of:

(a) providing a base material having an exterior surface;

(b) overlaying a first layer of material on said exterior surface of said base material that is harder than said base material when dry; and (c) overlaying a second layer of material on said first layer of material that is softer than said first layer of material when dry.

22. The method of claim 21 wherein said first layer is substantially evenly distributed along a major portion of the length of said base material.

23. The method of claim 21 wherein said second layer is substantially evenly distributed along a major portion of the length of said base material.

24. The method of claim 21 wherein said second layer of material defines said exterior surface of said trim detail.

25. The method of claim 21 wherein said base material is foam.

26. The method of claim 25 wherein said foam is expanded polystyrene foam.

27. The method of claim 21 wherein said base material is paper.

28. The method of claim 21 wherein said base material is wood.

29. The method of claim 21 wherein said base material is plastic.

30. The method of claim 21 wherein said first layer is a thermal barrier.

31. The method of claim 21 wherein said first layer is gypsum-based.

32. The method of claim 31 wherein said first layer includes glass-fiber.

33. The method of claim 32 wherein said first layer is chemically hardening.

34. The method of claim 21 wherein said first layer is adhered directly to said base material.

35. The method of claim 21 wherein said second layer is adhered directly to said first layer.

36. The method of claim 21 wherein said second layer is gypsum-based.

37. The method of claim 21 wherein said second layer is drywall material.

38. The method of claim 31 wherein said second layer is gypsum-based.

39. The method of claim 21 wherein said second layer includes plastic.

40. The method of claim 21 wherein said second layer is plaster.

41. The method of claim 21 wherein said second layer is stucco.

42. The method of claim 21 further comprising the step of maintaining at least one end portion of said exterior surface of said base material free from overlaying by said first layer and said second layer prior to said attachment to said structure.

43. The method of claim 21 further comprising the steps of:

(a) maintaining at least one end portion of said exterior surface of said base material free from overlaying by said first layer and said second layer prior to said attachment to said structure;

(b) providing another base material having an exterior surface;

(c) overlaying both a third layer of material on said exterior surface of said another base material that is harder than said another base material when dry and overlaying a fourth layer of material on said third layer of material that is softer than said third layer of material when dry while maintaining at least one end portion of said exterior surface of said another base material free from overlaying said third layer and said fourth layer prior to said attachment to said structure; and (d) attaching said at least one end portion of said exterior surface of said base material to said at least one end portion of said exterior surface of said another base material prior to said attachment of said base material and said another base material to said structure.

44. The method of claim 43 wherein said first layer of material is the same as said third layer of material and said second layer of material is the same as said fourth layer of material.

45. The method of claim 43 further comprising the steps of:

(a) attaching said attached said base material and said another base material to said structure; and (b) overlaying said free portion of said base material and said free portion of said another base material with a fifth layer of material to a level flush with said second layer and said fourth layer.

46. The method of claim 45 wherein said fifth layer of material is the same as said second layer of material.

47. The method of claim 21 wherein said overlaying said first layer is with a container that contains said first layer of material in a liquid state and said container is passed across said base material thereby coating said base material with said first layer of material.

48. The method of claim 21 wherein said overlaying said second layer is with a container that contains said second layer of material in a liquid state and said container is passed across said first layer of material thereby coating said first layer of material with said second layer of material.

49. The method of claim 47 wherein said container includes interchangeable blades that define an exterior contour substantially the same as said exterior surface of said trim detail.

50. The method of claim 47 wherein said container is pressurized.

51. The method of claim 47 wherein movement of said container along the length of said base material is motor driven.

52. A trim detail having an exterior surface with a contour for attachment to a structure comprising:

(a) a base material having an exterior surface with a contour generally matching said contour of said trim detail;

(b) a first layer of material overlaying said exterior surface of said base material that has a flame-spread rating of less than 25; and (c) a second layer of material overlaying said first layer of material that is softer than said first layer of material.

* * * * *